US006789552B1

(12) United States Patent
Robinson et al.

(10) Patent No.: US 6,789,552 B1
(45) Date of Patent: Sep. 14, 2004

(54) METHOD OF CLEANING A TOILET

(75) Inventors: Robert S. Robinson, Hamilton, OH (US); Robert G. Robinson, Hamilton, OH (US)

(73) Assignee: Kaivac, Inc., Hamilton, OH (US)

( * ) Notice: Subject to any disclaimer, the term of this patent is extended or adjusted under 35 U.S.C. 154(b) by 0 days.

(21) Appl. No.: 09/952,440

(22) Filed: Sep. 14, 2001

Related U.S. Application Data

(60) Provisional application No. 60/232,557, filed on Sep. 14, 2000.

(51) Int. Cl.[7] ..... B08B 9/093

(52) U.S. Cl. ..... 134/22.18; 134/22.19; 134/24; 134/34; 134/42; 4/662; 4/223; 4/420; 4/300; 239/373; 239/375

(58) Field of Search ..... 134/22.18, 22.19, 134/24, 34, 42, 166 R, 167 R, 168 R, 169 R, 198, 201; 4/662, 223, 420, 300; 239/337, 373, 375

(56) References Cited

U.S. PATENT DOCUMENTS

| | | | | |
|---|---|---|---|---|
| 2,605,478 A | | 8/1952 | Lassiter | 4/233 |
| 3,199,739 A | | 8/1965 | Corning et al. | 222/130 |
| 3,381,312 A | | 5/1968 | Whitla | 4/1 |
| 3,646,617 A | | 3/1972 | Heald | 4/1 |
| 3,724,764 A | * | 4/1973 | Hall | 239/587.3 |
| 4,183,105 A | | 1/1980 | Womack | 4/1 |
| 4,345,343 A | | 8/1982 | Shipman | 4/662 |
| 4,397,056 A | | 8/1983 | Miller | 15/22 R |
| 4,747,167 A | * | 5/1988 | Adams | 4/234 |
| 5,175,890 A | * | 1/1993 | Ruth | 4/233 |
| 5,454,123 A | | 10/1995 | Barabino | 4/662 |
| 5,564,134 A | | 10/1996 | Ruth | 4/233 |
| 5,647,074 A | * | 7/1997 | White et al. | 4/664 |
| 5,765,580 A | | 6/1998 | Dassi | 134/167 R |

FOREIGN PATENT DOCUMENTS

| | | |
|---|---|---|
| DE | 29601333 | * 6/1996 |
| FR | 2704251 | * 10/1994 |
| FR | 2728291 | * 6/1996 |

* cited by examiner

*Primary Examiner*—M. Kornakov
(74) *Attorney, Agent, or Firm*—Wood, Herron & Evans, L.L.P.

(57) ABSTRACT

A spray gun is connected to a source of pressurized liquid. In one aspect, the worker positions the nozzle of the spray gun into the bowl, adjacent the lower, interior edge of the rim, and aims the liquid outlet of the spray gun toward the primary interior surface of the bowl adjacent the lip of the rim. The worker then rotates the spray gun in a radial manner about the bowl, with the liquid outlet of the spray gun oriented toward the primary interior surface of the bowl adjacent the lip of the rim, while spraying a liquid through the liquid outlet of the spray gun. The worker may rest the spray gun nozzle against the lower, interior edge of the rim during the rotating step, thereby using the lower, interior edge as a guide to facilitate directional control of the liquid being sprayed from the spray gun.

19 Claims, 2 Drawing Sheets

METHOD OF CLEANING A TOILET

CROSS-REFERENCE TO RELATED APPLICATION

This patent document claims the benefit of the filing date of Provisional U.S. patent application No. 60/232,557 entitled "Method of Cleaning a Toilet" and filed on Sep. 14, 2000. The entire disclosure of that provisional U.S. patent document is incorporated into this application by reference.

BACKGROUND OF THE INVENTION

1. Field of the Invention

This invention is directed to methods of cleaning a toilet, and in particular, to methods of cleaning a toilet in which a worker may quickly and effectively clean a toilet while having minimal direct contact with the surfaces of the toilet.

2. Description of the Related Art

When using a restroom facility, a user hopes that the restroom, and especially the toilet, will be clean. However, as most people have experienced, that desire often is far from reality. In fact, the number-one building maintenance complaint is dirty restrooms, with dirty toilets being a chief cause for this leading building maintenance complaint. Moreover, everyone is affected. For example, if you have had to use a dirty toilet facility, you know what an unpleasant experience that is. Likewise, if you are responsible for cleaning a toilet or series of toilets, you know how unpleasant that experience is, particularly given the relatively ineffective tools which are used.

Traditional methods of cleaning a toilet typically involve the use of a spray bottle and scrub brush, and sometimes a mop, mop bucket, and paper toweling or rag. For routine cleaning of a toilet, a worker typically raises the toilet seat, sprays a cleaning chemical into the toilet bowl from a spray bottle, and brushes the inside surface of the toilet bowl below the water line with a scrub brush. The worker may also use the spray bottle to spray a cleaning solution onto the top and bottom of the toilet seat. The worker may then either bend down or kneel on the floor in order to apply cleaning solution from the spray bottle to the top surface of the toilet bowl rim and the exterior surface of the bowl itself. The worker also may choose to wipe down some of these surfaces. On a less frequent basis, the worker may use a mop and mop bucket, plunging the mop into the toilet bowl in order to temporarily lower the water level within the bowl. Then, the worker may manually scrub the water line with a hand-held brush.

As you can appreciate, even if a toilet is cleaned frequently, as described above, such cleaning methods are only partially effective, and therefore, remain unsatisfactory to both the user and the worker. Also, because these cleaning methods are highly hands-on, quite time consuming, and only partially effective, they are extremely demanding on the worker. For example, because the tools require a lot of "elbow grease" by the worker, the work is physically taxing. In addition, because the methods described above are only partially effective, the work often is rather demoralizing for the worker. In the short term, this combination of highly hands-on, physical work with only marginal results causes many workers to "cut corners" and not care about their work. In the longer term, the negative aspects of these methods lead to high worker turnover and a continuation of dirty toilet facilities.

SUMMARY OF THE INVENTION

The invention overcomes the above mentioned drawbacks by providing a method of cleaning a toilet which is simple, quick, and effective, which requires far less physical energy by the worker, and in which the worker has minimal direct-contact with any of the surfaces of the toilet. Accordingly, the method produces a sparkling-clean toilet for the user, and a cleaning methodology which raises the dignity and job satisfaction of the worker.

The method involves using a spray gun connected to a source of pressurized liquid, and if desired, using a blower nozzle connected to a source of forced air. In further detail, in one aspect of the invention, the worker sprays a liquid from the spray gun nozzle outlet onto various surfaces of the toilet including, for example, the seat, bowl, base or wall mount, flush handle, water tank, and/or water-supply pipe assembly, as appropriate. If desired, the liquid being sprayed from the outlet of the spray gun may include a cleaning-liquid composition, such as a solution formed from water and one or more cleaning chemicals, for example. Also, if desired, the worker may use a spray gun which has both a high-pressure mode and a low-pressure mode, as well as an adjustable spray pattern which, for example, may allow liquid to be sprayed from the gun in any of a number of different patterns ranging from a relatively wide, fan pattern to a relatively narrow, focused, pinpoint pattern. If such a spray gun is used to spray a cleaning solution or the like, the worker may apply the cleaning solution to these various surfaces using the low-pressure and/or fan-pattern mode, if desired. By way of example, depending upon the particular spray gun and source of pressure used to pressurize the liquid, the pressure at the spray gun in the low-pressure, fan-pattern mode may be from about 5 pounds per square inch ("psi") to about 60 psi.

In another aspect, if a cleaning chemical is used in the step described immediately above, the worker may then spray a rinsing liquid onto one or more of the various surfaces of the toilet If desired, the rinsing liquid may be water or a solution of water and a rinsing additive. Also, if desired, the worker may adjust the spray gun so that it is set to spray in a high-pressure and/or pinpoint-pattern mode. Depending on the spray gun and source of pressure used, the pressure at the spray gun in the high-pressure, pinpoint-pattern made may be from about 100 psi to about 600 psi. Because of the force of the liquid coming out of the spray gun in this mode, the worker is able to thoroughly clean various surfaces of the toilet via the raw mechanical force of the liquid as it contacts the surfaces. Also, if a cleaning chemical is used in the step discussed above, then this step serves to rinse the cleaning solution off of various surfaces of the toilet. In this step, in addition to spraying the upper surfaces of the toilet, such as the flush handle, tank, water-supply pipe assembly, wall-mount upper surface, and/or toilet-seat upper surface, the worker may raise the toilet seat, thereby enabling the worker to spray the bottom surface of the seat, the seat hinges, the upper and interior-sidewall surfaces of the rim, the exterior surface of the bowl, the base, and/or the wall mount. This aspect of the invention allows for thorough cleaning of any of the external surfaces of a toilet, most of which do not get properly cleaned using traditional methods.

In a further aspect of the invention, the worker may thoroughly clean not only the primary- interior surface of the bowl at and above the water line, but also an area of the bowl which rarely if ever is properly cleaned using traditional methods—namely the lip of the rim including the flush-water outlets, an area which tends to act as a safe harbor for dirt and germs. In this step, the worker positions the nozzle of the spray gun into the bowl, adjacent the lower, interior edge of the rim, and aims the liquid outlet of the spray gun toward the primary interior surface of the bowl adjacent the lip of the rim. The worker then rotates the spray gun in a radial manner about the bowl, with the liquid outlet of the spray gun oriented toward the primary interior surface of the bowl adjacent the lip of the rim, while spraying a liquid through the liquid outlet of the spray gun. In this fashion, the worker quickly and thoroughly cleans the lip of the rim including the flush-water outlets, as well as the primary interior surface of the bowl from the water line to the rim. If desired, the worker may rest the spray gun nozzle against the lower, interior edge of the rim during the rotating step, thereby using the lower, interior edge as a quick and easy guide to facilitate directional control of the liquid being sprayed from the spray gun. Also, if desired, the worker may operate the spray gun in a high pressure and/or pinpoint-pattern mode during this step, thereby increasing the force with which the liquid contacts the various surfaces being cleaned.

In another aspect, the worker holds the spray gun above the upper surface of the water in the bowl (i.e., the water line), and points the spray gun nozzle outlet at the upper surface of the water. The worker then sprays a liquid through the liquid outlet of the spray gun, thereby cleaning the primary interior surface of the bowl at and below the upper surface of the water. If desired, the worker may move the nozzle in a pattern above the surface of the water, thereby further enhancing the cleaning of the primary interior surface of the bowl at and/or below the upper surface of the water. In addition, if desired, the worker may adjust the spray gun so that it is operating in a high-pressure and/or pinpoint-pattern mode during this step.

In a further aspect of the invention, the worker sprays a liquid from the spray gun onto various exterior surfaces of the toilet, such as the upper and interior-sidewall rim surfaces, the bowl exterior surface, the base, and/or the junction where the base meets the floor. If a cleaning solution was applied in an earlier spraying step, then the worker may use this step to further clean and rinse various exterior surfaces using a liquid such as water or a solution of water and a rinse additive. If desired, the worker may have the spray gun in a high-pressure and/or pinpoint-pattern mode, thereby taking advantage of the more-intense mechanical cleaning action of the liquid being sprayed from the spray gun.

In another aspect, the worker directs forced air from the blower nozzle outlet onto the upper surface of the seat of the toilet, thereby facilitating removal of at least a portion of any liquid which may be remaining on the upper surface of the seat. The upper surface of the seat extends between an interior edge and an exterior edge. If desired, the worker may rotate the blower nozzle in a radial manner about the seat, with the outlet of the blower nozzle generally oriented so as to blow the portion of the liquid outward, in the direction of the seat exterior edge.

As may be appreciated from the various aspects of the invention described briefly above, the method of cleaning a toilet is both highly effective and highly efficient. In other words, a worker is able to clean a toilet facility far better, and in less time, when compared with traditional methods. Moreover, the method allows the worker to do a thorough job without having to touch soiled toilet surfaces. This combination of benefits results in dramatically improved worker satisfaction, a sense of dignity regarding the work being performed, and clean toilet facilities for you and me.

BRIEF DESCRIPTION OF THE DRAWINGS

The accompanying drawings, which are incorporated in, and constitute a part of, this specification, illustrate embodiments of the invention and, together with the general description of the invention given above, and the detailed description of versions of the invention given below, serve to explain the principles of the invention.

DETAILED DESCRIPTION OF VERSIONS OF THE INVENTION

As stated in the summary above, the invention involves using a spray gun connected to a source of pressurized liquid, and if desired, using a blower nozzle connected to a source of forced air. In carrying out the inventive method, a person may use any suitable spray gun, source of pressurized liquid, blower nozzle, and source of forced air. By way of example, and without limitation, a person may use the relevant components of the multi-functional cleaning machine described in Robinson U.S. Pat. No. 6,206,980, assigned to Kaivac, Inc. of Hamilton, Ohio. The entire disclosure of that patent is hereby incorporated into this patent document by reference. Furthermore, the versions of the inventive method of cleaning a toilet described in detail below are described in connection with various components of the multi-functional cleaning machine described in the '980 patent.

Figure 1:
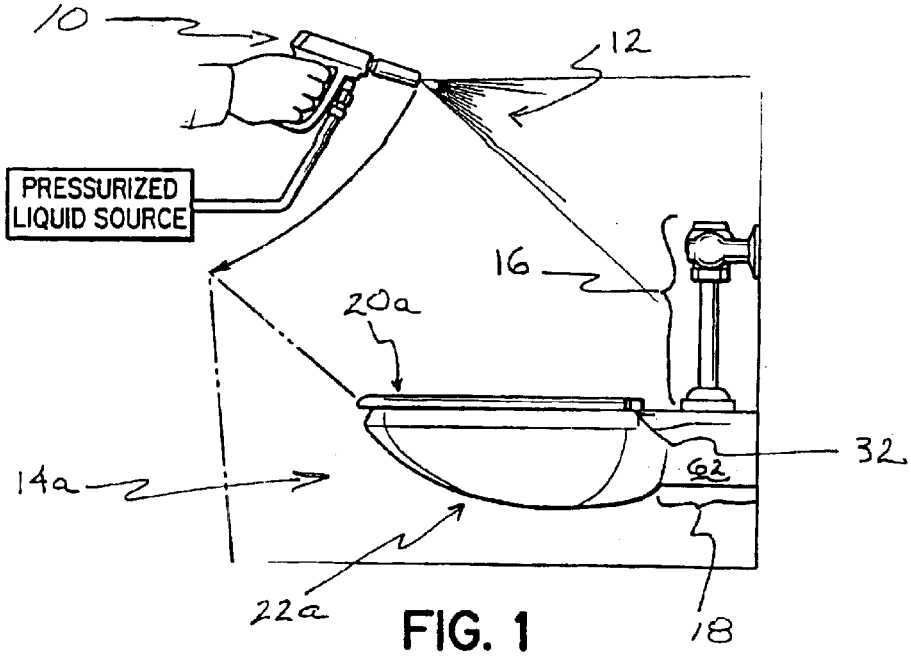
FIG. 1 is a side view of a worker spraying a cleaning solution from a spray gun onto various inside and outside surfaces of a toilet.

The worker uses a spray gun which has both a high-pressure mode and a low-pressure mode, as well as an adjustable spray pattern which allows a liquid to be sprayed from the spray gun in a number of different patterns ranging from a relatively wide, fan pattern to a relatively narrow, pinpoint pattern. With reference to FIG. 1, the worker adjusts the spray gun 10 so that it is in a low-pressure, fan-pattern mode. In this mode, when activated by the worker, the spray gun 10 sprays a cleaning solution 12 which is a mixture of water and one or more cleaning chemicals. As shown in FIG. 1, the worker applies the cleaning solution 12 to the interior and exterior surfaces of the wall-mount toilet 14*a*, including the water-supply pipe assembly 16, wall mount 18, seat 20*a*, bowl 22*a*, and adjacent floor and wall surfaces. Because the worker is using a low-pressure mode, the liquid cleaning solution 12 does not become aerosolized, thereby enhancing worker safety.

Now the worker adjusts the settings of the spray gun 10 so that the spray gun 10 is in a high-pressure mode with a focused, or pinpoint, spray pattern. In this high-pressure mode, cleaning chemical is not drawn into and through the spray gun 10. Instead, the liquid drawn into and through the spray gun 10 is water which, if desired, may contain a rinse additive and/or defoaming additive.

Figure 2:
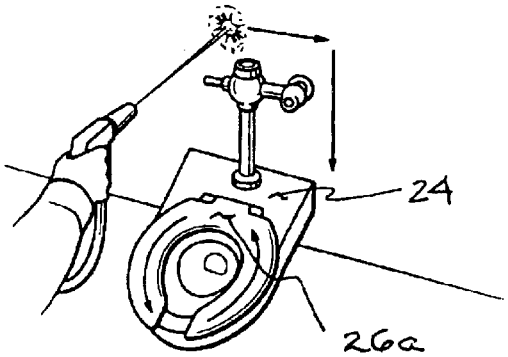
FIG. 2 is an elevated, perspective view of a worker spraying a high-pressure, focused stream of a liquid onto various upper surfaces of a toilet.

As shown in FIG. 2, the worker blasts and rinses soils and cleaning solution from the upper surfaces of the toilet 14*a*, in a top-to-bottom manner. Given the wall-mount toilet 14*a* shown, the surfaces include a portion of the wall adjacent the toilet 14*a*, the water-supply pipe assembly 16, the upper surface 24 of the wall mount 18, and the upper surface 26*a* of the seat 20*a*.

Figure 3:
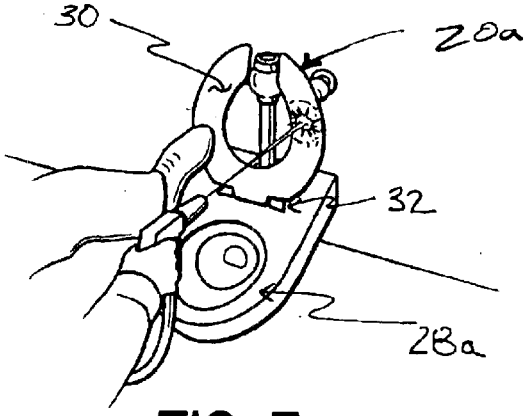
FIG. 3 is an elevated, perspective view of a worker raising a toilet seat with their leg and spraying a high-pressure, pinpoint blast of a liquid from a spray gun onto the hinges and bottom surface of the toilet seat.

Next, as shown in FIG. 3, the worker quickly and easily raises the seat 20*a* to an elevated position by wedging a portion of their shoe between the front portion of the seat 20*a* and the rim 28*a*, and lifting up with the foot. In this fashion, the worker is able to thoroughly clean the toilet 14*a* without the worker's hands ever touching any of the soiled surfaces being cleaned. Once the worker has raised the seat 20*a* , they bring their foot back to the floor, and blast and rinse the lower surface 30 of the seat 20*a* and the seat hinges 32, using the spray gun 10 in its high-pressure, pinpoint-pattern mode.

Figure 4:
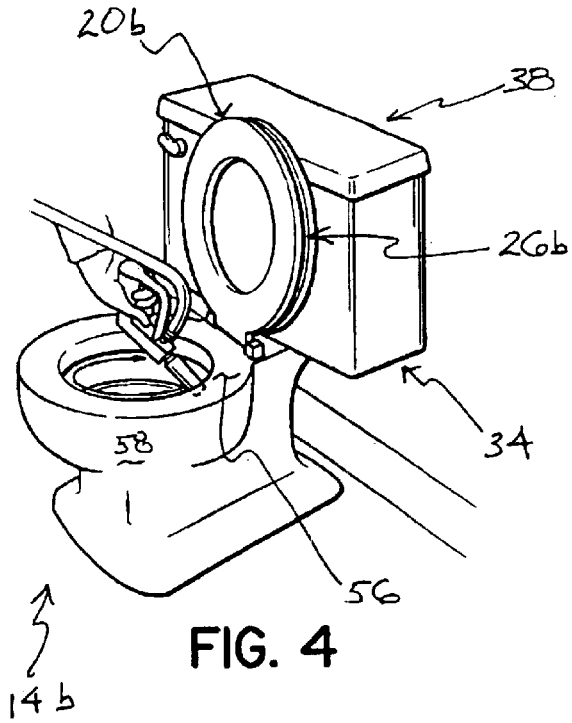
FIG. 4 is an elevated, perspective view of a worker rotating a spray gun in a radial manner about a toilet bowl, with the liquid outlet of the spray gun oriented toward the interior surface of the bowl adjacent the underside surface of the rim, while spraying a high-pressure, pinpoint spray of a liquid from the spray gun.
Figure 5:
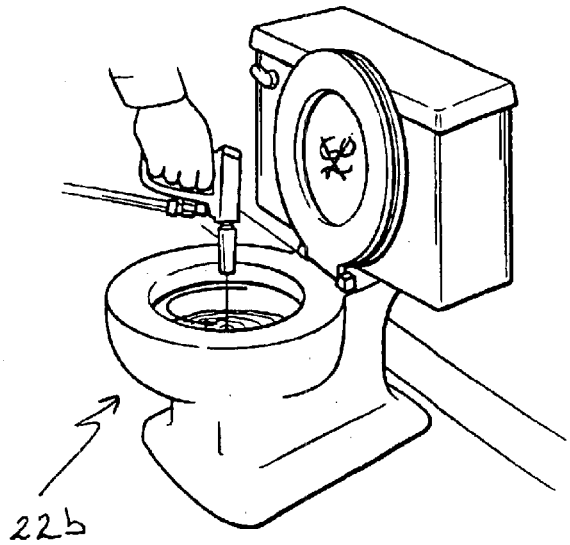
FIG. 5 is an elevated, perspective view of a worker directing a high-pressure, pinpoint stream of a liquid onto and through the surface of the water in a toilet bowl.
Figure 6:
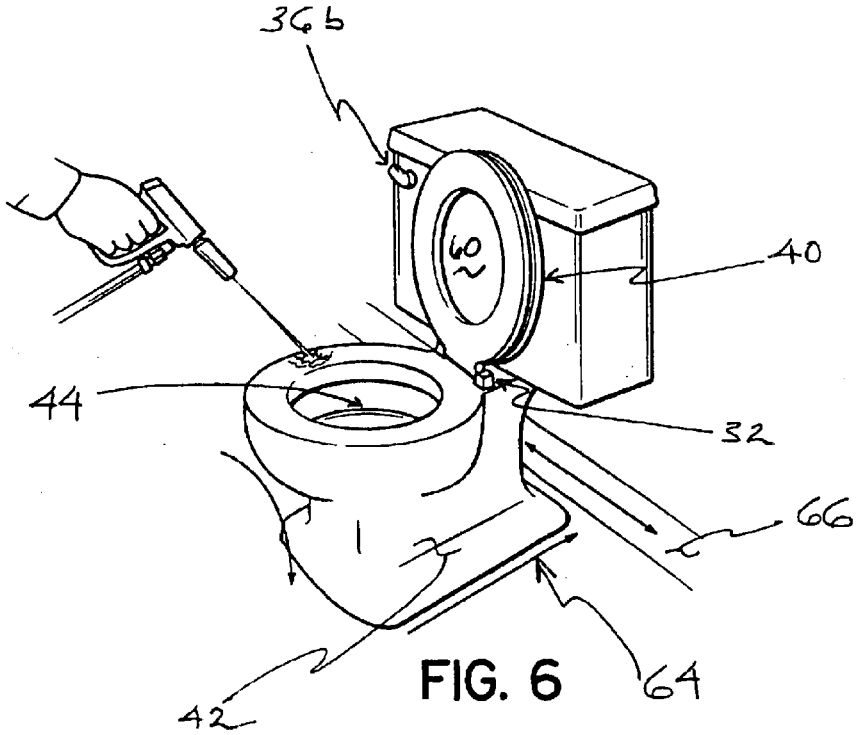
FIG. 6 is an elevated, perspective view of a worker directing a high-pressure, pinpoint stream of a liquid onto various exterior surfaces of a toilet.
Figure 1:
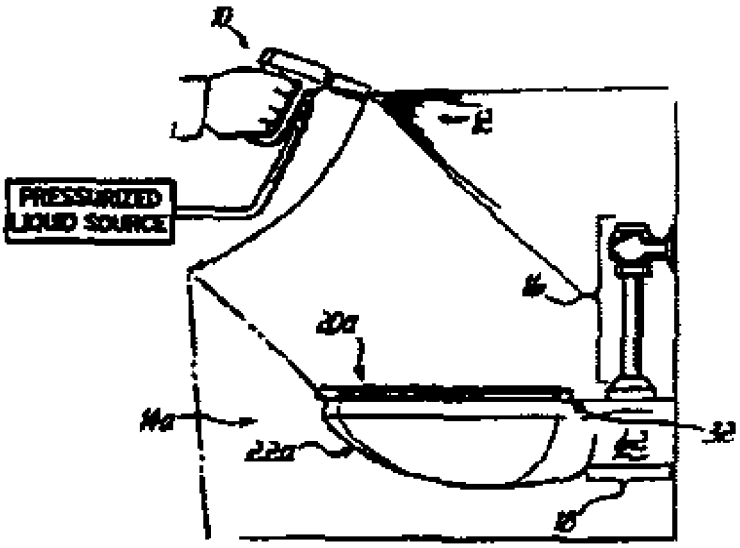
Figure 2:
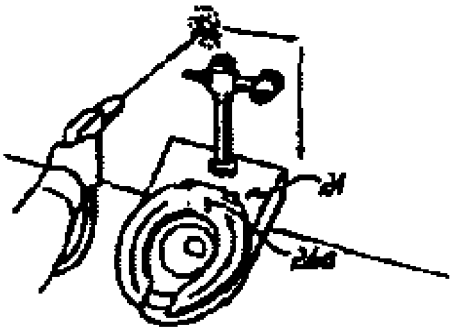
Figure 3:
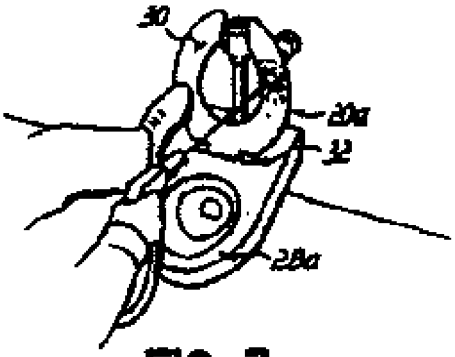
Figure 7:
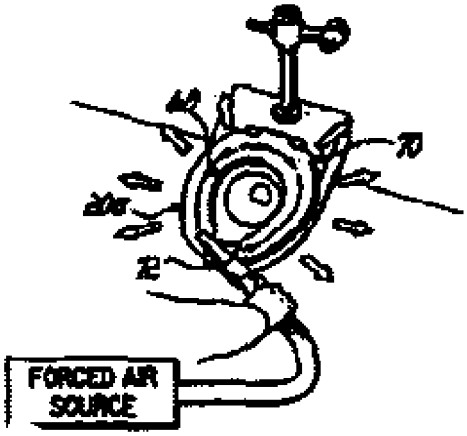
Figure 8:
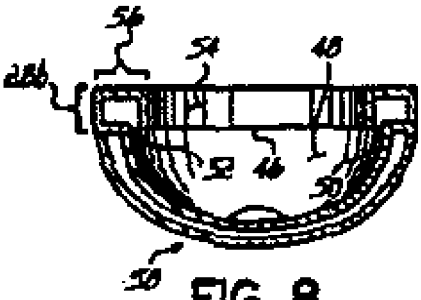
Figure 4:
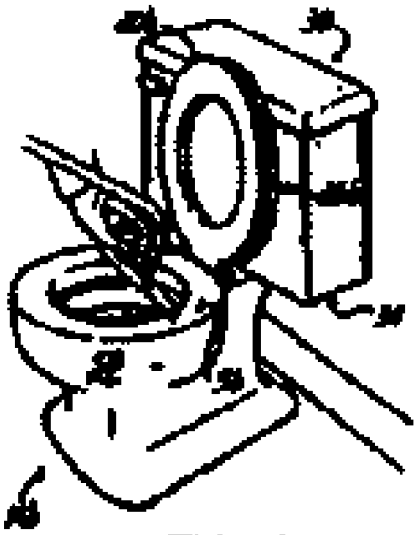
Figure 5:
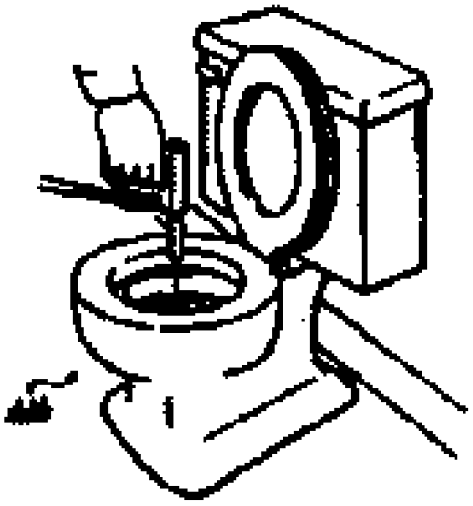
Figure 6:
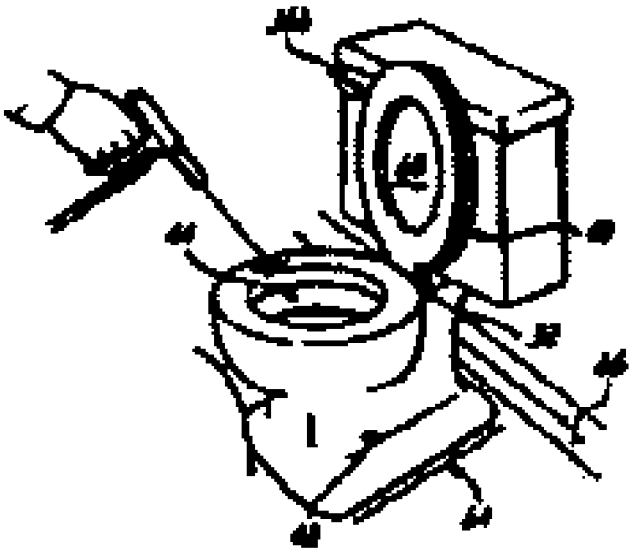

As will readily be appreciated, the method may be used to clean any style of toilet. By way of example, FIGS. 1–3 and 7 depict a waft-mount toilet 14*a*; whereas FIGS. 4–6 show a floor-mount toilet 14*b*. Accordingly, if a floor-mount toilet 14*b*, such as the one shown in FIGS. 4–6, is being cleaned, it should be appreciated that the steps described in connection with FIGS. 1–3 above are equally applicable, with slight variations being made to accommodate the components of a toilet which may differ from one toilet style to another. For example, the floor-mounted toilet 14*b* shown in FIGS. 4–6 has a water tank 34, a flush handle 36 extending from the water tank 34, a tank top 38, a lid 40 hingedly positioned adjacent the seat 20*b*, and a bowl 22*b* which includes a base or pedestal. Accordingly, the worker simply makes slight modifications in the chemical-application and blast-rinse steps described above, in order to accommodate the different surfaces. For example, with a floormount toilet 14*b* such as the one shown in FIGS. 4–6, the worker sprays the cleaning solution onto the tank top 38, water tank 34, flush handle 36*b*, and lid upper surface (not shown). The worker then flips the lid 40 to a raised position as described above, and sprays the seat upper-surface 26*b* and other inside and outside surfaces of the toilet 14*b*, including the base portion 42 of the bowl 22*b*.

Figure 8:
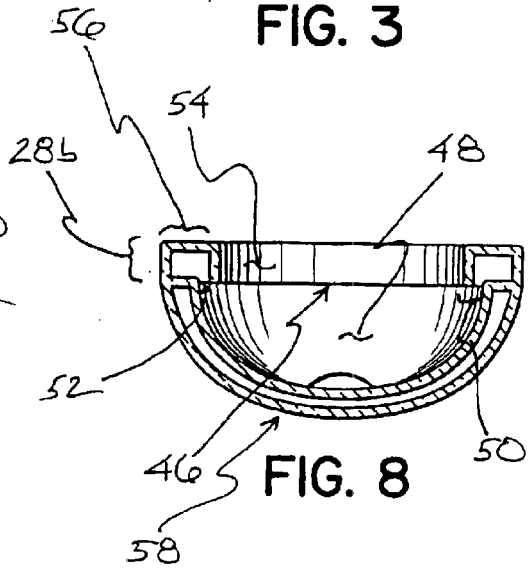
FIG. 8 is a front, cross-sectional view of a toilet bowl.

With reference to FIGS. 4 and 8, the worker next cleans the interior surface of the toilet bowl 22*b*, at and above the water line 44. In further detail, the worker positions the nozzle of the spray gun 10 into the bowl 22*b*, adjacent the lower, interior edge 46 of the rim 28*b*, and aims the liquid outlet of the spray gun 10 toward the primary interior surface 48 of the bowl 22*b*, adjacent the lip 50 of the rim 28*b*. Then, using the rim interior edge 46 as a guide (e.g., by contacting a portion of the nozzle with the interior edge), the worker activates the spray gun 10 and rotates the spray gun 10 in a radial manner about the bowl 22*b*, thereby blasting and rinsing, and therefore cleaning, the lip 50 of the rim 28*b*, including the flush-water outlets 52 distributed in the lip 50, as well as the primary interior surface 48 of the bowl 22*b* at and above the water line 44.

With reference to FIG. 5, in order to clean the primary interior surface 48 of the bowl 22*b* at and below the water line 44, the worker maintains the high-pressure, pinpoint-pattern mode of the spray gun 10, and holds the spray gun 10 so that the nozzle outlet is pointed downward into the bowl 22*b*, with the nozzle outlet being approximately 2 to 10 inches above the upper surface of the water in the bowl 22*b*. The worker then pulls the trigger (not shown) of the spray gun 10 and moves the spray gun 10 in a circular pattern, with the nozzle outlet constantly pointing downward into the bowl 22*b*. In addition, the worker raises or lowers the spray gun 10 as needed, in order to position the nozzle outlet at a height which minimizes or eliminates any splashing, while the worker is blasting and rinsing this surface 48. In this fashion, the worker thoroughly cleans the primary interior surface 48 of the bowl 22*b* at and below the water line 44.

At this point, with the spray gun 10 in the high-pressure, pinpoint-pattern mode, the worker blasts and rinses any surfaces, other than the primary interior surface 48 of the bowl 22*b*, which need blast-action cleaning and/or rinsing. Such surfaces include the rim-interior sidewall 54, rim upper-surface 56, and bowl exterior-surface 58. Also, depending upon the particular type of toilet being cleaned, additional surfaces may include, for example, the base portion of the bowl 22*b* and the lower surface 60 of the lid 40 (as shown in FIG. 6), or the side surfaces 62 of the wall-mount portion 18 of the bowl 22*a* of a wall-mount toilet 14*a*. In this step, the worker blasts and rinses these surfaces starting with the higher surfaces and working toward the floor. In addition, the worker blast-cleans and rinses the edges 64 where the toilet 14*a*,b meets the wall and/or floor, as well as the portion of the wall baseboard 66 adjacent the toilet 14*b*.

In a next step, the worker uses a wet-vac floor tool (not shown) to suck up the dirty liquid on the floor adjacent the toilet. One such wet-vac floor tool is described in Robinson U.S. Pat. No. 6,206,980.

Figure 7:
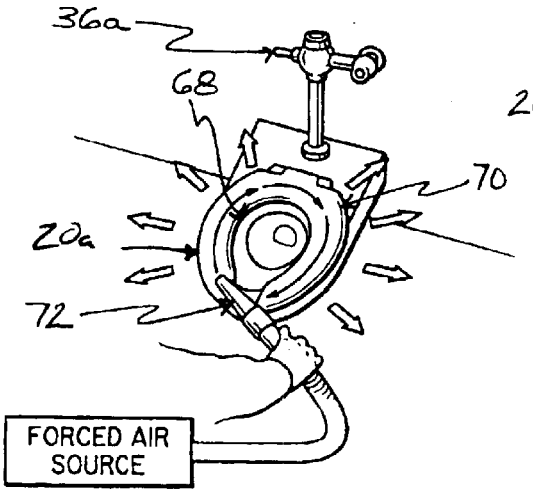
FIG. 7 is an elevated, perspective view of a worker directing forced air from the outlet of a blower nozzle onto the upper surface of a toilet seat in a radial direction about the seat.

With reference to FIG. 7, in an optional step, the worker may lower the now-clean toilet seat 20*a*, and blow dry the upper surface 26*a* of the seat 20*a*. The upper surface 26*a* of the seat 20*a* extends between an interior edge 68 and an exterior edge 70. In blow drying the seat 20*a*, the worker rotates a blower nozzle 72 in a radial manner about the seat 20*a*, with the outlet of the blower nozzle 72 generally oriented so as to blow any residual liquid laterally outward away from the upper surface 26*a* of the seat 20*a*. Also, if desired, the worker may blow dry the flush handle 36*a* of the toilet 14*a*.

As seen from this detailed description, the invention provides a method of cleaning a toilet which is simple, quick, and effective, which requires far less physical energy by the worker, and in which the worker has minimal direct-contact with any of the surfaces of the toilet. Accordingly, the method produces a sparkling-clean toilet for the user, and a cleaning methodology which raises the dignity and job satisfaction of the worker.

While the present invention has been illustrated by a description of various versions, and while the illustrative versions have been described in considerable detail, it is not the intention of the inventor to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of the inventor's general inventive concept.

What is claimed is:

1. A method of cleaning a toilet, the toilet having a bowl with a rim and a primary interior surface, the rim having a lip and a lower, interior edge, the method comprising the steps of:

positioning a portable source of pressurized liquid at a location, which enables a spray gun to reach the bowl of the toilet when the spray gun is connected to the portable source, the portable source including an electromechanical pump;

positioning a nozzle of the spray gun into the bowl adjacent the lower, interior edge of the rim, the spray gun being connected to the portable source of pressurized liquid and having liquid outlet at an outer end of the nozzle;

aiming the liquid outlet of the spray gun toward the primary interior surface of the bowl adjacent the lip of the rim; and rotating the spray gun in a radial manner about the bowl, with the liquid outlet of the spray gun oriented toward the primary interior surface of the bowl adjacent the lip of the rim, while spraying a liquid through the liquid outlet of the spray gun, thereby cleaning the lip of the rim and the primary interior surface of the bowl.

2. The method of claim 1 wherein the nozzle of the spray gun contacts the lower, interior edge of the rim during the rotating step, thereby facilitating directional control of the liquid being sprayed from the spray gun.

3. The method of claim 1 wherein the pressure at the spray gun is from about 100 pounds per square inch ("psi") to about 600 psi.

4. The method of claim 1 wherein the liquid exiting the liquid outlet of the spray gun has a generally focused, pinpoint, spray pattern.

5. The method of claim 1 wherein the toilet further includes a seat the method further including the step of having the seat in a raised position before the rotating step.

6. The method of claim 1 wherein the toilet further includes a seat, the method further including the step of spraying a liquid through the liquid outlet of the spray gun onto the seat.

7. The method of claim 6 wherein the liquid includes a cleaning chemical, whereby the spraying step of claim 6 includes spraying a cleaning-liquid composition.

8. The method of claim 6 wherein the pressure at the spray gun is from about 5 pounds per square inch ("psi") to about 60 psi.

9. The method of claim 6 wherein the liquid exiting the liquid outlet of the spray gun has a generally fan-shaped spray pattern.

10. The method of claim 7 wherein the step of spraying a cleaning-liquid composition occurs before the method steps of claim 1.

11. The method of claim 7 further including the step of spraying a rinsing liquid through the liquid outlet of the spray gun onto the seat, thereby rinsing at least a portion of the cleaning-liquid composition off of the seat.

12. The method of claim 11 wherein the seat has an upper surface, the rinsing step including orienting the seat in a lowered position and spraying the rinsing liquid onto the upper surface.

13. The method of claim 12 wherein the seat has a lower surface, the rinsing step further including orienting the seat in a raised position and spraying the rinsing liquid onto the lower surface.

14. The method of claim 1 wherein the bowl contains water having an upper surface, the method further including the step of pointing the liquid outlet of the spray gun at the upper surface and spraying a liquid rough the liquid outlet of the spray gun, thereby cleaning the primary interior surface of the bowl below the upper surface of the water.

15. The method of claim 14 wherein the pressure at the spray gun is from about 100 pounds per square inch ("psi") to about 600 psi.

16. The method of claim 14 wherein the liquid exiting the liquid outlet of the spray gun has a generally focused, pinpoint, spray pattern.

17. The method of claim 7 wherein the bowl further includes an exterior surface, the method further including the step of spraying a rinsing liquid through the liquid outlet of the spray gun onto the exterior surface of the bowl, thereby rinsing at least a portion of the cleaning-liquid composition off of the exterior surface.

18. The method of claim 6 further including the step of directing forced air onto the seat from an outlet of a blower nozzle which is connected to a source of forced air, thereby facilitating removal of at least a portion of the liquid from the seat.

19. The method of claim 18 wherein the seat has an upper surface extending between an interior edge and an exterior edge, the method further including the step of rotating the blower nozzle in a radial manner about the seat, with the outlet of the blower nozzle generally oriented so as to blow the portion of the liquid outward, in the direction of the seat exterior edge.

* * * * *

UNITED STATES PATENT AND TRADEMARK OFFICE

CERTIFICATE OF CORRECTION

PATENT NO. : 6,789,552 B1
DATED : September 14, 2004
INVENTOR(S) : Robert S. Robinson et al.

It is certified that error appears in the above-identified patent and that said Letters Patent is hereby corrected as shown below:

Title page should be deleted and substituted therefore the attached title page

The informal drawing sheets (Sheets 1 and 2) should be replaced by the following formal drawing sheets (Sheets 1 and 2) as shown on the attached page Column 2,
Line 35, "toilet if desired, the rinsing liquid" should read -- toilet. If desired, the rinsing liquid --.
Line 40, "pinpoint-pattern made may be from" should read -- pinpoint-pattern mode may be from --.
Line 59, "the primary-interior surface of" should read -- the primary interior surface of --.

Column 5,
Line 30, "depict a waft-mouonted toilet" should read -- depict a wall-mounted toilet --.
Line 44, "with a floormount toilet" should read -- with a floor-mount toilet --.

Column 6,
Line 60, "intention of the inventor to" should read -- intention of the inventors to --.

Column 7,
Line 2, "inventor's general inventive concept" should read -- inventors' general inventive concept --.
Line 39, "includes a seat the method" should read -- includes a seat, the method --.

UNITED STATES PATENT AND TRADEMARK OFFICE

CERTIFICATE OF CORRECTION

PATENT NO. : 6,789,552 B1
DATED : September 14, 2004
INVENTOR(S) : Robert S. Robinson et al.

It is certified that error appears in the above-identified patent and that said Letters Patent is hereby corrected as shown below:

Column 8,
Line 19, "spraying a liquid rough the liquid outlet" should read -- spraying a liquid through the liquid outlet --.

Signed and Sealed this

Thirty-first Day of May, 2005

JON W. DUDAS
*Director of the United States Patent and Trademark Office*

(12) United States Patent
Robinson et al.

(10) Patent No.: US 6,789,552 B1
(45) Date of Patent: Sep. 14, 2004

(54) METHOD OF CLEANING A TOILET

(75) Inventors: Robert S. Robinson, Hamilton, OH (US); Robert G. Robinson, Hamilton, OH (US)

(73) Assignee: Kaivac, Inc., Hamilton, OH (US)

( * ) Notice: Subject to any disclaimer, the term of this patent is extended or adjusted under 35 U.S.C. 154(b) by 0 days.

(21) Appl. No.: 09/952,440

(22) Filed: Sep. 14, 2001

Related U.S. Application Data

(60) Provisional application No. 60/232,557, filed on Sep. 14, 2000.

(51) Int. Cl.[7] ..... B08B 9/093

(52) U.S. Cl. ..... 134/22.18; 134/22.19; 134/24; 134/34; 134/42; 4/662; 4/223; 4/420; 4/300; 239/373; 239/375

(58) Field of Search ..... 134/22.18, 22.19, 134/24, 34, 42, 166 R, 167 R, 168 R, 169 R, 198, 201; 4/662, 223, 420, 300; 239/337, 373, 375

(56) References Cited

U.S. PATENT DOCUMENTS

| | | | | | |
|---|---|---|---|---|---|
| 2,605,478 | A | | 8/1952 | Lassiter | 4/233 |
| 3,199,739 | A | | 8/1965 | Corning et al. | 222/130 |
| 3,381,312 | A | | 5/1968 | Whitla | 4/1 |
| 3,646,617 | A | | 3/1972 | Heald | 4/1 |
| 3,724,764 | A | * | 4/1973 | Hall | 239/587.3 |
| 4,183,105 | A | | 1/1980 | Womack | 4/1 |
| 4,345,343 | A | | 8/1982 | Shipman | 4/662 |
| 4,397,056 | A | | 8/1983 | Miller | 15/22 R |
| 4,747,167 | A | * | 5/1988 | Adams | 4/234 |
| 5,175,890 | A | * | 1/1993 | Ruth | 4/233 |
| 5,454,123 | A | | 10/1995 | Barabino | 4/662 |
| 5,564,134 | A | | 10/1996 | Ruth | 4/233 |
| 5,647,074 | A | * | 7/1997 | White et al. | 4/664 |
| 5,765,580 | A | | 6/1998 | Dassi | 134/167 R |

FOREIGN PATENT DOCUMENTS

| | | | |
|---|---|---|---|
| DE | 29601333 | * | 6/1996 |
| FR | 2704251 | * | 10/1994 |
| FR | 2728291 | * | 6/1996 |

* cited by examiner

*Primary Examiner*—M. Kornakov
(74) *Attorney, Agent, or Firm*—Wood, Herron & Evans, L.L.P.

(57) ABSTRACT

A spray gun is connected to a source of pressurized liquid. In one aspect, the worker positions the nozzle of the spray gun into the bowl, adjacent the lower, interior edge of the rim, and aims the liquid outlet of the spray gun toward the primary interior surface of the bowl adjacent the lip of the rim. The worker then rotates the spray gun in a radial manner about the bowl, with the liquid outlet of the spray gun oriented toward the primary interior surface of the bowl adjacent the lip of the rim, while spraying a liquid through the liquid outlet of the spray gun. The worker may rest the spray gun nozzle against the lower, interior edge of the rim during the rotating step, thereby using the lower, interior edge as a guide to facilitate directional control of the liquid being sprayed from the spray gun.

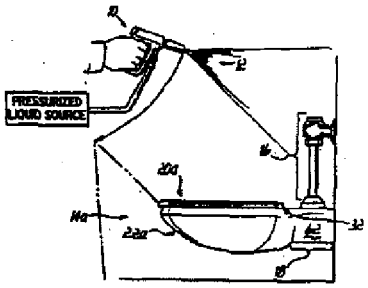

19 Claims, 2 Drawing Sheets